US011311124B2

(12) United States Patent
Rayfield

(10) Patent No.: US 11,311,124 B2
(45) Date of Patent: Apr. 26, 2022

(54) DRINK PROTECTOR

(71) Applicant: Vicky M. Rayfield, Washington, DC (US)

(72) Inventor: Vicky M. Rayfield, Washington, DC (US)

( * ) Notice: Subject to any disclaimer, the term of this patent is extended or adjusted under 35 U.S.C. 154(b) by 202 days.

(21) Appl. No.: 15/843,063

(22) Filed: Dec. 15, 2017

(65) Prior Publication Data

US 2018/0168376 A1 Jun. 21, 2018

Related U.S. Application Data

(60) Provisional application No. 62/434,896, filed on Dec. 15, 2016.

(51) Int. Cl.
*A47G 19/22* (2006.01)

(52) U.S. Cl.
CPC ..... *A47G 19/2211* (2013.01); *A47G 19/2227* (2013.01); *A47G 19/2266* (2013.01); *A47G 19/2272* (2013.01); *A47G 2400/123* (2013.01)

(58) Field of Classification Search
CPC ..... A47G 19/2211; A47G 19/2266; A47G 19/2272; A47G 19/2227; A47G 2400/123; A47G 2019/2238; B65D 2401/50; B65D 85/8043; B65D 81/3211; B65D 81/3288; B65D 81/32; B65D 43/0214; B65D 51/14; B65D 2543/00092; B65D 2543/00314; B65D 2543/00037; F21K 2/06; A47J 31/0668; A47J 31/407; B65B 29/10; B01F 13/0018; Y02W 30/80; Y02W 30/807
USPC ..... 220/705, 709, 212, 796; 362/101, 154, 362/375, 84, 104; 206/459.1, 807, 457
See application file for complete search history.

(56) References Cited

U.S. PATENT DOCUMENTS

| | | | | |
|---|---|---|---|---|
| 3,452,921 | A * | 7/1969 | Donovan | B65D 43/0218 215/274 |
| 6,874,906 | B1 * | 4/2005 | Dorney | F21K 2/06 362/101 |
| 8,100,287 | B2 * | 1/2012 | Milnark | A47G 19/2211 215/317 |
| 8,714,393 | B2 * | 5/2014 | Buck | A47G 19/2205 220/212 |
| 10,274,475 | B2 * | 4/2019 | Abramson | G01N 33/146 |
| 2002/0181752 | A1 * | 12/2002 | Wallo | A61B 5/442 382/130 |
| 2004/0140314 | A1 * | 7/2004 | Li | A47G 21/18 220/709 |
| 2017/0105433 | A1 * | 4/2017 | Debyser | A23L 2/40 |
| 2019/0002192 | A1 * | 1/2019 | Wicks | A47J 31/0668 |

OTHER PUBLICATIONS www.thermofisher.com/liquidchormography. pp. 26 and 96 (Year: 2015).*
Vitamin B Complex—WholeHealth Chicago, pp. 2 and 3 (Year: 2009).*

* cited by examiner

*Primary Examiner* — Anthony D Stashick
*Assistant Examiner* — James M Van Buskirk
(74) *Attorney, Agent, or Firm* — Cozen O'Connor

(57) ABSTRACT

Within the scope of the present invention is a drink protector that prevents adulteration of the contents within a beverage container.

17 Claims, 4 Drawing Sheets

DRINK PROTECTOR

CROSS-REFERENCE TO RELATED APPLICATIONS

This application claims priority to U.S. Provisional Patent Application No. 62/434,896 filed Dec. 15, 2016, which is hereby incorporated by reference in its entirety.

BACKGROUND

Drugs, such as Rohypnol ("Roofies"), Gamma-hydroxybutyrate ("GHB"), and Ketamine Hydrochloride ("Special K"), when combined with alcohol produces a state called anterograde amnesia, in which a person forgets what happens while under the influence of the drug. Moreover, a person will experience a range of symptoms including slurred speech, weakness and staggering, dizziness, confusion, severe drowsiness, and hallucinations. These drugs are practically undetectable since they are odorless and tasteless. In some circumstances, these drugs are introduced into a victim's alcoholic beverage to induce the aforementioned deleterious effects.

Preventative guidance is often limited to being cognizant of your beverage container at all times, and to make arrangements with friends to be aware of any suspicious people or events. Clearly, more is required to protect potential victims from being exposed to these undetectable drugs.

SUMMARY OF THE INVENTION

One aspect of the present invention is a drink protector comprising a polymer cover having a first surface, a second surface, and an interstitial cavity therebetween; a luminescent medium disposed in the interstitial cavity; and a conduit extending from the first surface to the second surface and through the interstitial cavity.

In one embodiment, the polymer cover is circular. In another embodiment, the drink protector further includes an adhesive disposed proximate to the periphery of the second surface of the polymer cover.

In another embodiment, the polymer cover further includes a skirt having a proximal skirt end and distal skirt end, wherein the proximal skirt end is connected to the periphery of the second surface of the polymer cover.

In one embodiment, a conduit is disposed proximate to an arc along the circumference of a circular polymer cover.

In one embodiment, the cover includes a flap pivotably connected to the polymer cover proximate to the conduit.

In one embodiment, the conduit is disposed away from the edge of the polymer cover and defined to receive a straw therein.

In one embodiment, the conduit is in intimate contact with said straw, wherein said first or second surface will rupture upon removal of said straw.

A drink protector comprising: a polymer cover having a first surface, a second surface, and an interstitial cavity therebetween, a luminescent medium disposed in the interstitial cavity; and a conduit extending from the first surface to the second surface and through the interstitial cavity; said conduit having an inner diameter, and a straw having an outer diameter greater than the inner diameter; said conduit flexibly reliant to accept the straw and defining an intimate connection between said inner diameter of the conduit and at least a portion of said straw.

In one embodiment, the straw comprises a one-way valve.

In one embodiment, said intimate connection between said inner diameter of the conduit and at least a portion of said straw forms a bond, wherein said bond ruptures upon removal of said straw, releasing the luminescent medium through said rupture.

DETAILED DESCRIPTION

Before the present device is described, it is to be understood that this invention is not limited to the particular processes, compositions, or methodologies described, as these may vary. It is also to be understood that the terminology used in the description is for the purpose of describing the particular versions or embodiments only, and is not intended to limit the scope of the present invention which will be limited only by the appended claims. Unless defined otherwise, all technical and scientific terms used herein have the same meaning as commonly understood by one of ordinary skill in the art. Although any methods and materials similar or equivalent to those described herein can be used in the practice or testing of embodiments of the present invention, the preferred methods, devices, and materials are now described.

It must also be noted that as used herein and in the appended claims, the singular forms "a," "an," and "the" include plural reference unless the context clearly dictates otherwise.

Figure 1A:
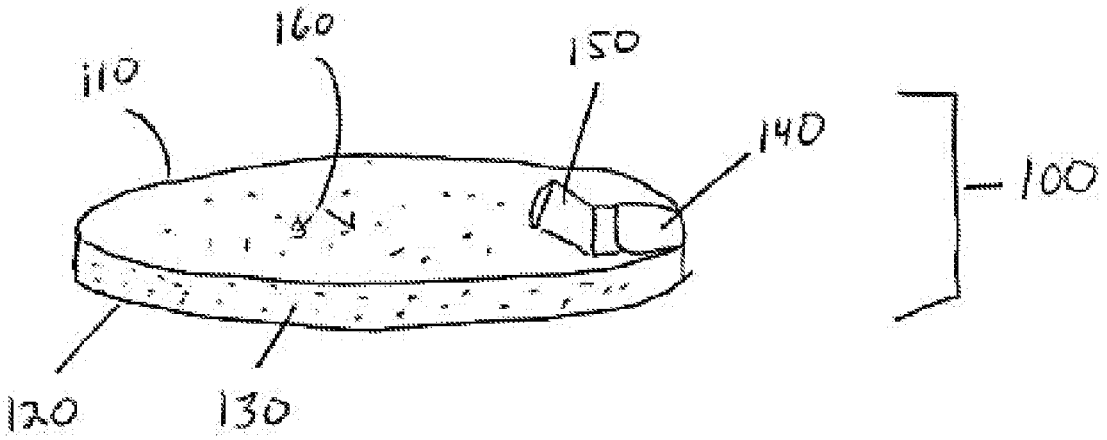
FIGS. 1A-B depict one embodiment of a drink protector within the scope of the present invention.
Figure 1B:
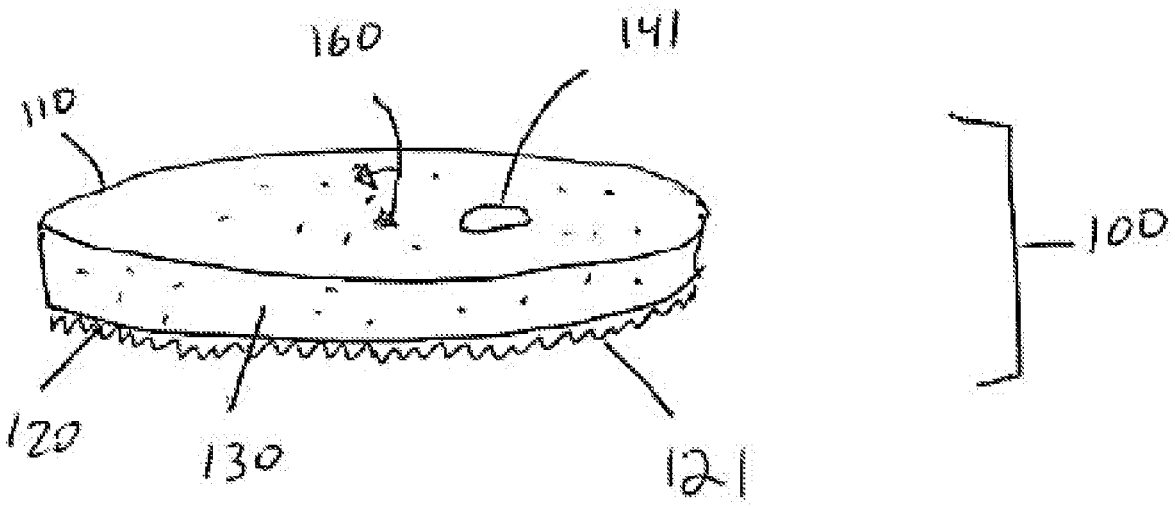

FIG. 1A and FIG. 1B illustrate embodiments of a drink protector within the scope of the present invention where the drink protector includes a polymer cover 100 having a first surface 110, a second surface 120, and an interstitial cavity 130 therebetween. The embodiments shown in FIG. 1A and FIG. 1B present the polymer cover 100 with a circular geometry, however, FIG. 1A and FIG. 1B merely represent two embodiments within the scope of the present invention. The drink protector may have different geometries to accommodate and fully cover the lip of different beverage containers having various geometries. Moreover, the size of the polymer cover may vary depending on the size of the beverage container. It is within the contemplation of the inventor that various embodiments of polymer cover 100 within the scope of the present invention may accommodate bottles, glasses, and any other beverage containing object.

In FIG. 1B, an adhesive layer 121 is disposed on the periphery of the second surface 120 to secure the drink protector on the lip of a beverage container such that foreign substances such as powders or liquids are prevented from entering the beverage container. However, the second surface may be made of a suitable material, having elastic and/or adhesive properties without the addition of a separate adhesive layer 121.

In another embodiment, a luminescent medium is disposed in the interstitial cavity 130. In one embodiment the luminescent medium is a fluorescent liquid which includes but is not limited to copper doped zinc sulfide (Science Bob Store, Inc., Bethel, Conn.). In another embodiment the luminescent medium such as aqueous vitamin B high in Thiamine, which fluoresces in the presence of an ultra violet light source such as a black light. A person of ordinary skill in the art necessarily understands that luminescent media within the scope of the present invention includes all media that can luminesce in dark environments. In one embodiment, the luminescent medium delivers a bitter or unpleasant taste to indicate to an individual that the contents of the beverage container has been adulterated and to discontinue imbibing.

In one embodiment, the interstitial cavity 130 includes a plurality of luminescent members 160. The plurality of luminescent members 160 may be disposed within the interstitial cavity 130 alone, in combination with a liquid, or in combination with a luminescent medium. In one embodiment, the liquid or luminescent medium used in combination with the plurality of luminescent members 160 delivers a bitter or otherwise unpleasant taste to indicate to an individual that the contents of the beverage container has been adulterated and to discontinue imbibing. In another embodiment, the plurality of luminescent members 160 delivers a bitter or otherwise unpleasant taste to indicate to an individual that the contents of the beverage container has been adulterated and to discontinue imbibing.

As shown in FIG. 1A, one embodiment within the scope of the present invention includes a conduit 140 disposed proximate to the edge of the polymer cover 100. The conduit 140 extends from the first surface 110 to the second surface 120 through the interstitial cavity 130 such that in embodiments that include luminescent media and/or a plurality of members 160, the luminescent media and/or luminescent members 160 remain contained within the interstitial cavity 130. In one embodiment a flap 150 is pivotably connected to the first surface 110 proximate to the conduit 140 such that the flap can fully cover the conduit 140. In other embodiments, the conduit 140 includes a membrane that is coplanar with or parallel to the first surface 110 or the second surface 120.

Figure 3:
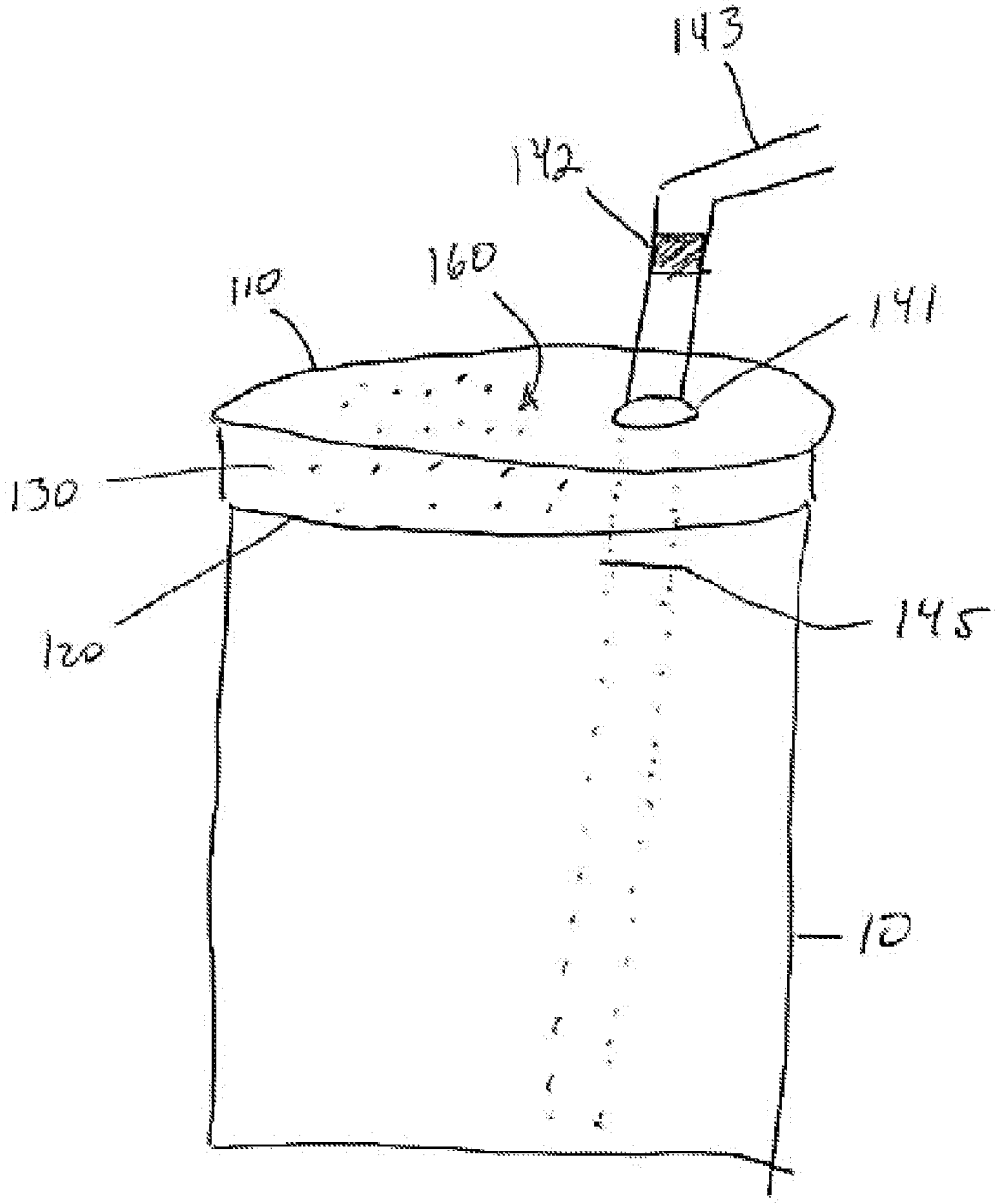
FIG. 3 depicts an embodiment of a drink protector secured to a container.

As shown in FIG. 1B, other embodiments within the scope of the present invention include a conduit 141 disposed at locations away from the edge of polymer cover 100. As depicted in FIG. 3, in some embodiments, the rim of the conduit 141 fits intimately to the sides of a straw such that liquids and fine solids cannot traverse the interfacial boundary of the straw and rim of the conduit 141. In one embodiment, a straw can be urged through the conduit 141 and through the membranes such that intimate contact at the interfacial boundary between the straw and the membrane prevents liquids and fine solids from permeating into the body of the beverage container covered by the drink protector. In one embodiment, removal of a straw 143 from the polymer cover 100 will breach the second surface 120 thereby releasing luminescent media and/or luminescent members 160 into the body of a beverage container covered by the drink protector.

The straw 143 of FIG. 3 comprises a one-way valve 142 that allows for fluids to pass solely from within the container to the outside. Thus, a liquid or solid cannot be passed through the straw into the drink container 10. In certain embodiments, the inner-diameter of the conduit 141 is smaller than the outer diameter of the straw 143. The conduit 141 being made of a flexible material, is suitable to be stretched to receive and accept the larger diameter straw 143. In one embodiment, the action creates a bond or connection or sufficient strength to prevent the straw from being removed without rupture of at least one layer of the polymer cover 100.

In another embodiment, the straw 143 contains a lip 145 to prevent the straw from being removed through the conduit 141. Accordingly, the straw must be inserted into the conduit 141 before placing onto the drink.

Figure 2:
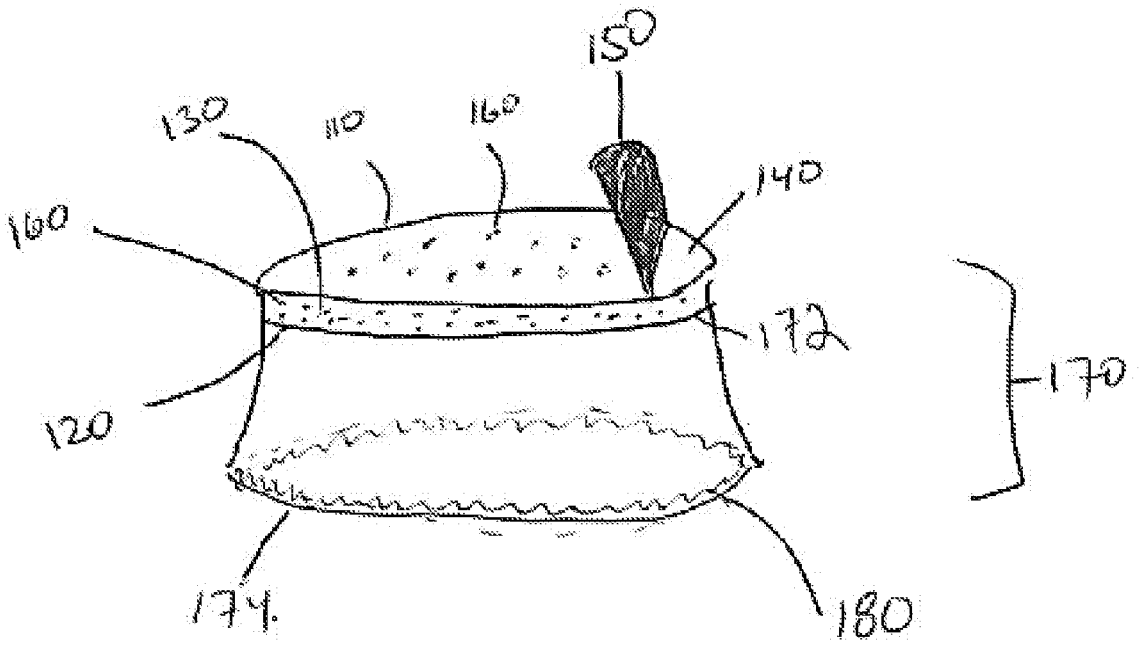
FIG. 2 depicts one embodiment where the drink protector includes a skirt.

As shown in FIG. 2, one embodiment within the scope of the present invention includes a skirt 170 having a proximal skirt end 172 and a distal skirt end 174. In one embodiment, the proximal skirt end 172 is connected to the periphery of the second surface 120. In one embodiment, the skirt 170 is pliable. In another embodiment, the skirt 170 is substantially rigid and provides a friction fit over a beverage container. In one embodiment, an adhesive layer 180 is disposed on the skirt surface facing the beverage container proximate to the distal skirt end 174 to secure the polymer cover 100 over the lip of a beverage container.

Figure 4:
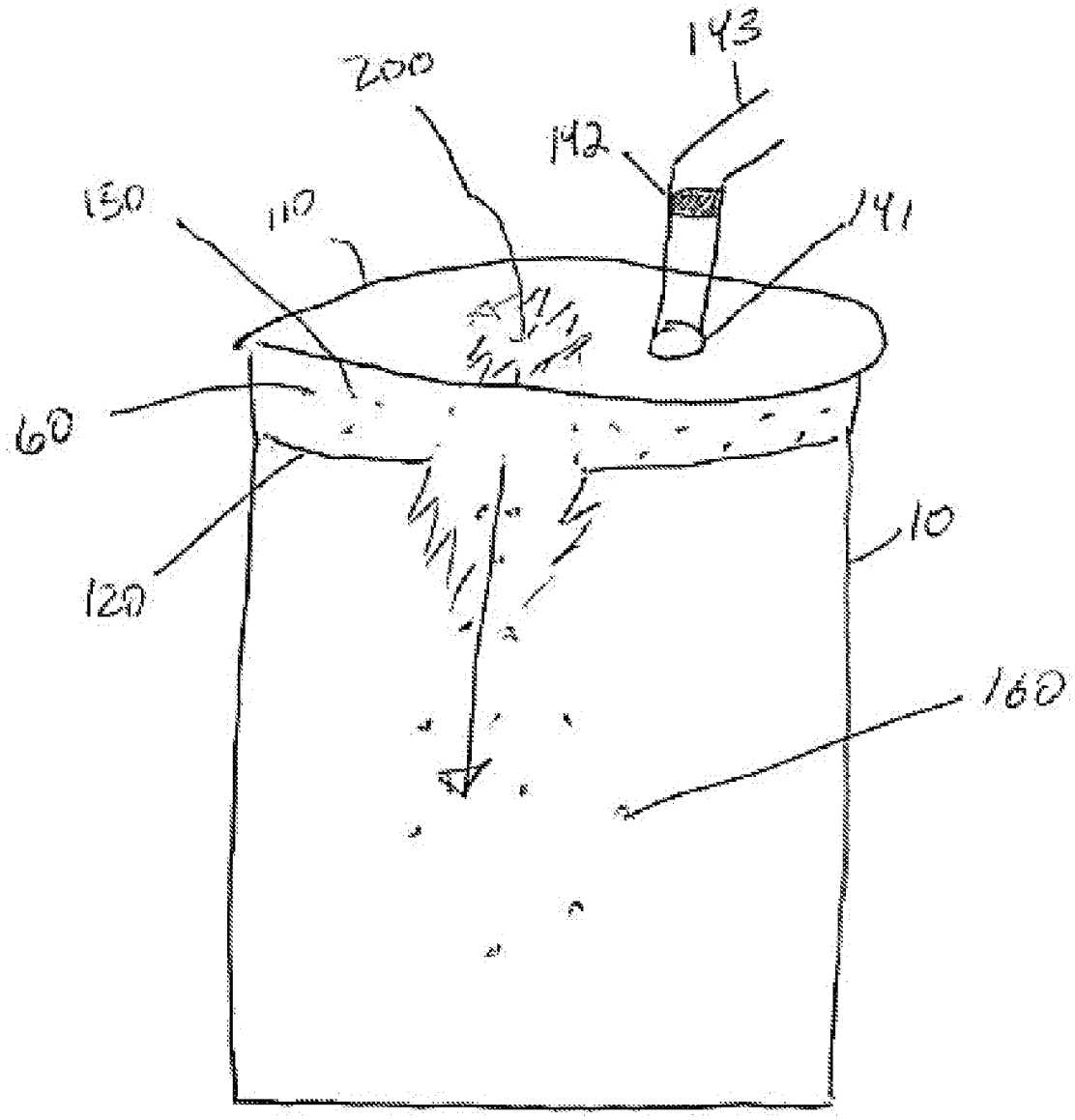
FIG. 4 depicts an embodiment of the drink protector as ruptured.

FIG. 4 depicts an event wherein the first surface 110 and second surface 120 are breached. Upon such occurrence, the luminescent medium and/or the luminescent members 160 will seep from the interstitial cavity 130 through the breach 200 and into the body of a beverage container covered by the polymer cover 100. The luminescent material now within the body of the beverage container 10 will visually indicate that the contents of the beverage container have been adulterated.

In one embodiment, the luminescent medium and/or the luminescent members 160 deliver a bitter or otherwise unpleasant taste to indicate to an individual that the contents of the beverage container has been adulterated.

It should be understood that the examples and embodiments described herein are for illustrative purposes only and that various modifications or changes in light thereof will be suggested to persons skilled in the art and are to be included within the spirit and purview of this application and the scope of the appended claims. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the disclosure without limitation thereto.

What is claimed is:

1. A drink protector for a beverage container comprising:

a polymer cover having an upper planar surface, a lower planar surface, and a breachable interstitial cavity therebetween, wherein the upper planar surface, the lower planar surface, and the breachable interstitial cavity each include a diameter to fully cover a lip of the beverage container; and a luminescent aqueous vitamin B solution disposed in the breachable interstitial cavity, wherein the lower planar surface is above a body of the beverage container and is capable of disposing at least a portion of the luminescent aqueous vitamin B solution into the body of the beverage container upon a breach of at least the lower planar surface, and wherein the luminescent aqueous vitamin B solution is capable of indicating its presence in the body of the beverage container by a visual indication, a taste indication, or both.

2. The drink protector of claim 1, wherein the polymer cover is circular.

3. The drink protector of claim 1, further comprising an adhesive disposed along the periphery of the lower planar surface.

4. The drink protector of claim 1, wherein the polymer cover further comprises a skirt having a proximal skirt end and distal skirt end, wherein the proximal skirt end is connected to the periphery of the polymer cover.

5. The drink protector of claim 4, further comprising an adhesive disposed on the periphery of the distal skirt end of the skirt.

6. The drink protector of claim 1, further comprising a conduit extending from the upper planar surface to the lower planar surface and through the breachable interstitial cavity.

7. The drink protector of claim 6, wherein the conduit is disposed proximate to the edge of the polymer cover.

8. The drink protector of claim 7, further comprising a flap pivotably connected to the polymer cover proximate to the conduit.

9. The drink protector of claim 8, wherein the flap is composed of a polymer.

10. The drink protector of claim 1, wherein the luminescent aqueous vitamin B solution comprises a plurality of luminescent members disposed in the breachable interstitial cavity between the upper planar surface and lower planar surface.

11. The drink protector of claim 6, wherein the conduit is disposed away from the edge of the polymer cover and defined to receive a straw therein.

12. The drink protector of claim 11, wherein the conduit is in frictional contact with said straw, wherein said upper planar or lower planar surface will rupture upon removal of said straw.

13. A drink protector for a beverage container comprising:

a polymer cover having an upper planar surface, a lower planar surface, and a breachable interstitial cavity therebetween, wherein the upper planar surface, the lower planar surface, and the breachable interstitial cavity each include a diameter to fully cover a lip of the beverage container, a luminescent aqueous vitamin B solution disposed in the breachable interstitial cavity; and a conduit extending from the upper planar surface to the lower planar surface and through the breachable interstitial cavity; said conduit having an inner diameter, and a straw having an outer diameter greater than the inner diameter; said conduit flexibly reliant to accept the straw and defining a frictional connection between said inner diameter of the conduit and at least a portion of said straw, wherein the lower planar surface and the conduit are above a body of the beverage container and at least one of the lower planar surface and the conduit is capable of disposing at least a portion of the luminescent aqueous vitamin B solution into the body of the beverage container upon a breach of at least one of the lower planar surface and the conduit, and wherein the luminescent aqueous vitamin B solution is capable of indicating its presence in the body of the beverage container by a visual indication, a taste indication, or both.

14. The drink protector of claim 13 wherein said straw comprises a one-way valve.

15. The drink protector of claim 13 wherein said frictional connection between said inner diameter of the conduit and at least a portion of said straw forms a bond, wherein said bond ruptures upon removal of said straw.

16. The drink protector of claim 13 wherein said straw comprises a lip having a greater diameter than said outer diameter.

17. The drink protector of claim 16 wherein said lip is disposed below said one-way valve.

* * * * *